US007344606B2

(12) United States Patent
Mino et al.

(10) Patent No.: US 7,344,606 B2
(45) Date of Patent: Mar. 18, 2008

(54) PERMANENT MAGNET MANUFACTURING METHOD AND PRESS APPARATUS

(75) Inventors: Shuji Mino, Suita (JP); Noboru Nakamoto, Yawata (JP)

(73) Assignee: Neomax Co., Ltd., Osaka (JP)

( * ) Notice: Subject to any disclaimer, the term of this patent is extended or adjusted under 35 U.S.C. 154(b) by 567 days.

(21) Appl. No.: 10/489,339

(22) PCT Filed: Oct. 18, 2002

(86) PCT No.: PCT/JP02/10861

§ 371 (c)(1),
(2), (4) Date: Mar. 12, 2004

(87) PCT Pub. No.: WO03/038845

PCT Pub. Date: May 8, 2003

(65) Prior Publication Data

US 2004/0241034 A1 Dec. 2, 2004

(30) Foreign Application Priority Data

Oct. 31, 2001 (JP) ..... 2001-335510

(51) Int. Cl.
*H01F 1/04* (2006.01)

(52) U.S. Cl. ..... 148/103; 148/101; 419/12

(58) Field of Classification Search ..... None
See application file for complete search history.

(56) References Cited

U.S. PATENT DOCUMENTS 4,981,532 A 1/1991 Takeshita et al.
5,666,635 A 9/1997 Kaneko et al.
6,432,354 B2 8/2002 Ogawa et al.

FOREIGN PATENT DOCUMENTS

| | | | |
|---|---|---|---|
| JP | 56-074907 | | 6/1981 |
| JP | 11-195548 | | 7/1999 |
| JP | 2000-182867 | | 6/2000 |
| JP | 2001-093712 | | 4/2001 |
| JP | 2001-226701 | * | 8/2001 |

OTHER PUBLICATIONS

Complete English Language Translation of Japanese Patent Document 2001-226701.*
Official Action for Korean Application No. 10-2003-7007385, dated Dec. 24, 2004.

* cited by examiner

*Primary Examiner*—John P. Sheehan
(74) *Attorney, Agent, or Firm*—Nixon Peabody LLP; Jeffrey L. Costellia

(57) ABSTRACT

An anisotropic bonded magnet is produced at a low cost by avoiding various problems caused by remanence. Also, the unit weight and density of a compact is increased by filling even a cavity, having no easily feedable shape, with a magnet powder just as intended. An anisotropic bonded magnet is produced by feeding the cavity of a press machine with a magnetic powder (e.g., an HDDR powder) and compacting it. After the magnetic powder has been positioned outside of the cavity, an oscillating magnetic field (e.g., an alternating magnetic field) is created in a space including the cavity. The magnetic powder is transported into the cavity while being aligned parallel to the oscillating direction of the oscillating magnetic field. Thereafter, the magnetic powder is compressed within the cavity to make a compact for an anisotropic bonded magnet.

10 Claims, 6 Drawing Sheets

PERMANENT MAGNET MANUFACTURING METHOD AND PRESS APPARATUS

TECHNICAL FIELD

The present invention relates to a method for producing a permanent magnet and also relates to a press machine. More particularly, the present invention relates to a permanent magnet producing method and press machine that can be used effectively to make an anisotropic bonded magnet.

BACKGROUND ART

An R—Fe—B based rare-earth magnet (where R is one of the rare-earth elements including Y, Fe is iron, and B is boron) is a typical high-performance permanent magnet, has a structure including, as a main phase, an $R_2Fe_{14}B$ phase, which is a tertiary tetragonal compound, and exhibits excellent magnet performance.

Such R—Fe—B based rare-earth magnets are roughly classifiable into sintered magnets and bonded magnets. A sintered magnet is produced by compacting a fine powder of an R—Fe—B based magnet alloy (with a mean particle size of several μm) with a press machine and then sintering the resultant compact. On the other hand, a bonded magnet is usually produced by compacting a mixture (i.e., a compound) of a powder of an R—Fe—B based magnet alloy (with particle sizes of about 100 μm) and a binder resin within a press machine.

The sintered magnet is made of a powder with relatively small particle sizes, and therefore, the respective powder particles thereof exhibit magnetic anisotropy. For that reason, an aligning magnetic field is applied to the powder being compacted by the press machine, thereby obtaining a compact in which the powder particles are aligned with the direction of the magnetic field.

In the bonded magnet on the other hand, the powder particles used have particle sizes exceeding the single domain critical size, and normally exhibit no magnetic anisotropy and cannot be aligned under a magnetic field applied. Accordingly, to produce an anisotropic bonded magnet in which the powder particles are aligned with particular directions, a technique of making a magnetic powder, of which the respective powder particles exhibit the magnetic anisotropy, needs to be established.

To make a rare-earth alloy powder for an anisotropic bonded magnet, an HDDR (hydrogenation-disproportionation-desorption-recombination) process is currently carried out. The "HDDR" process means a process in which the hydrogenation, disproportionation, desorption and recombination are carried out in this order. In this HDDR process, an ingot or a powder of an R—Fe—B based alloy is maintained at a temperature of 500° C. to 1,000° C. within an $H_2$ gas atmosphere or a mixture of an $H_2$ gas and an inert gas so as to occlude hydrogen. Thereafter, the hydrogenated ingot or powder is subjected to a desorption process at a temperature of 500° C. to 1,000° C. until a vacuum atmosphere with an $H_2$ partial pressure of 13 Pa or less or an inert atmosphere with an $H_2$ partial pressure of 13 Pa or less is created. Then, the desorbed ingot or powder is cooled, thereby obtaining an alloy magnet powder.

An R—Fe—B based alloy powder, produced by such an HDDR process, exhibits huge coercivity and has magnetic anisotropy. The alloy powder has such properties because the metal structure thereof substantially becomes an aggregation of crystals with very small sizes of 0.1 μm to 1 μm. More specifically, the high coercivity is achieved because the grain sizes of the very small crystals, obtained by the HDDR process, are close to the single domain critical size of a tetragonal $R_2Fe_{14}B$ based compound. The aggregation of those very small crystals of the tetragonal $R_2Fe_{14}B$ based compound will be referred to herein as a "recrystallized texture". Methods of making an R—Fe—B based alloy powder having the recrystallized texture by the HDDR process are disclosed in Japanese Patent Gazettes for Opposition Nos. 6-82575 and 7-68561, for example.

However, if an anisotropic bonded magnet is produced with a magnetic powder prepared by the HDDR process (which will be referred to herein as an "HDDR powder"), then the following problems will arise.

A compact, obtained by pressing a mixture (i.e., a compound) of the HDDR powder and a binder resin under an aligning magnetic field, has been strongly magnetized by the aligning magnetic field. If the compact remains magnetized, however, a magnet powder may be attracted toward the surface of the compact or the compacts may attract and contact with each other to be chipped, for example. In that case, it will be very troublesome to handle such compacts in subsequent manufacturing process steps. For that reason, before unloaded from the press machine, the compact needs to be demagnetized sufficiently. Accordingly, before the magnetized compact is unloaded from the press machine, a "degaussing process" of applying a degaussing field such as a demagnetizing field, of which the direction is opposite to that of the aligning magnetic field, or an alternating attenuating field to the compact needs to be carried out. However, such a degaussing process normally takes as long a time as several tens of seconds. Accordingly, in that case, the cycle time of the pressing process will be twice or more as long as a situation where no degaussing process is carried out (i.e., the cycle time of an isotropic bonded magnet). When the cycle time becomes that long, the mass productivity will decrease and the manufacturing cost of the magnet will increase unintentionally.

As for a sintered magnet on the other hand, even if the compact thereof is not degaussed sufficiently, the compact is magnetized just slightly if ever. Also, in the sintering process step, the magnet powder is exposed to an elevated temperature that is higher than the Curie temperature thereof. Thus, the magnet powder will be completely degaussed before subjected to a magnetizing process step. In contrast, as for an anisotropic bonded magnet, if the compact thereof remains magnetized when unloaded from the press machine, then the magnetization will remain there until the magnetizing process step. And if the bonded magnet remains magnetized in the magnetizing process step, the magnet is very hard to magnetize due to the hysteresis characteristic of the magnet.

In order to overcome the problems described above, a main object of the present invention is to provide a method and a press machine for producing an easily magnetizable permanent magnet (e.g., an anisotropic bonded magnet among other things) at a reduced cost by avoiding various problems caused by the remanence.

Another object of the present invention is to provide a method for producing an anisotropic bonded magnet and a press machine, which can fill even a cavity having no easily feedable shape with a magnet powder just as intended and thereby can increase the unit weight density of the compact.

DISCLOSURE OF INVENTION

In order to overcome the problems described above, preferred embodiments of the present invention provide An anisotropic bonded magnet producing method according to the present invention is a method for producing an anisotropic bonded magnet by feeding a magnetic powder into a cavity of a press machine and compacting the magnetic powder. The method includes the steps of: applying an oscillating magnetic field to a space including the cavity; moving the magnetic powder toward the inside of the cavity while aligning the magnetic powder parallel to the direction of the oscillating magnetic field; and compacting the magnetic powder inside of the cavity, thereby obtaining a compact.

In one preferred embodiment, the oscillating magnetic field is also applied in the step of compacting the magnetic powder inside of the cavity.

In another preferred embodiment, the oscillating magnetic field within the cavity has its maximum value adjusted such that the compact, which has just been pressed by the press machine, has a surface flux density of 0.005 tesla or less.

In another preferred embodiment, the maximum value of the oscillating magnetic field within the cavity is adjusted to 120 kA/m or less.

In a more preferable embodiment, the maximum value of the oscillating magnetic field is adjusted to 100 kA/m or less. In a most preferable embodiment, the maximum value of the oscillating magnetic field is adjusted to 80 kA/m or less.

In another preferred embodiment, after the magnetic powder has been compacted inside of the cavity, the compact is unloaded from the cavity without being subjected to any degaussing process.

The oscillating magnetic field may either be an alternating magnetic field or include a plurality of pulse magnetic fields.

In another preferred embodiment, the direction of the oscillating magnetic field within the cavity is perpendicular to the press direction.

In another preferred embodiment, the direction of the oscillating magnetic field within the cavity is substantially horizontal.

In another preferred embodiment, the cavity has an opening of which the smallest portion has a horizontal size of 5 mm or less, and the biggest portion of the cavity has a depth of 10 mm or more.

In another preferred embodiment, at least a portion of the magnetic powder is an HDDR powder.

In another preferred embodiment, the press machine includes: a die having a through hole; and a lower punch, which reciprocates inside of the through hole and with respect to the die. The step of moving the magnetic powder toward the inside of the cavity includes the steps of: positioning a feeder box, including the magnetic powder, over the through hole of the die after the through hole has been closed up with the lower punch; and moving the lower punch downward with respect to the die, thereby defining the cavity under the feeder box.

A press machine according to the present invention includes: a die having a through hole; an upper punch and a lower punch, which are able to reciprocate inside of the through hole and with respect to the die; and a powder feeder for feeding a magnetic powder into a cavity that is defined inside of the through hole of the die. The press machine further includes an apparatus for applying an oscillating magnetic field to the magnetic powder being transported into the cavity.

In one preferred embodiment, the oscillating magnetic field applying apparatus is able to apply the oscillating magnetic field to the magnetic powder that has been fed into the cavity and is being compacted by the upper and lower punches.

A permanent magnet according to the present invention is produced by a compaction process. The magnet is obtained by aligning and compacting a magnetic powder inside of a press machine under an oscillating magnetic field. The magnet has a remanence represented by a surface flux density of 0.005 tesla or less when unloaded from the press machine without being subjected to any degaussing process.

An anisotropic bonded magnet according to the present invention is obtained by binding a magnet powder with a resin. When a magnetic field of 0 kA/m to 800 kA/m is applied to the magnet for magnetization purposes, the ratio $\Delta B/\Delta H$ of an increase $\Delta B$ in magnetic flux to an increase $\Delta H$ in the strength of the magnetic field is 0.025%/(kA/m) or more.

BEST MODE FOR CARRYING OUT THE INVENTION

Figure 1A:
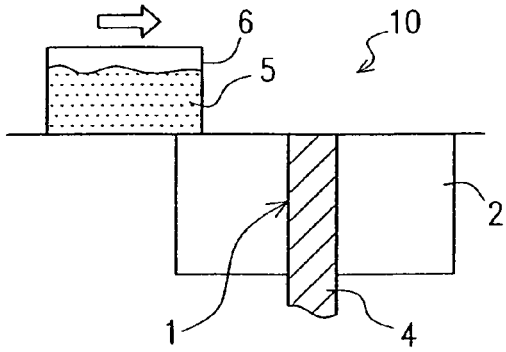
FIGS. 1(*a*) through 1(*f*) are cross-sectional views showing how the main members of a press machine according to a preferred embodiment of the present invention operate in respective manufacturing process steps.
Figure 1D:
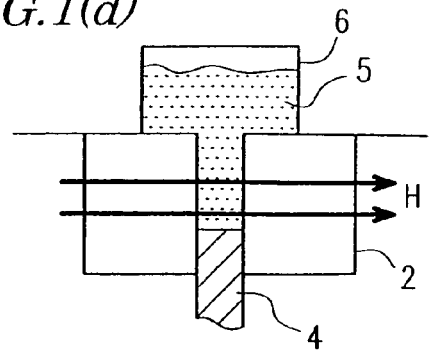
Figure 1B:
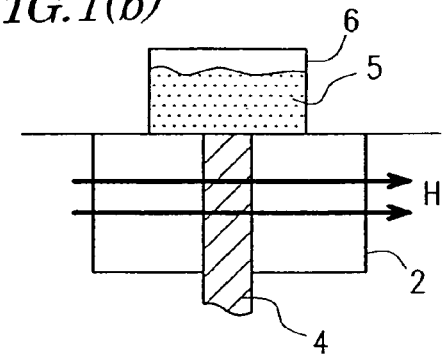
Figure 1E:
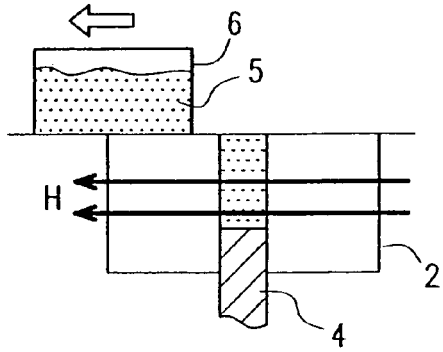
Figure 1C:
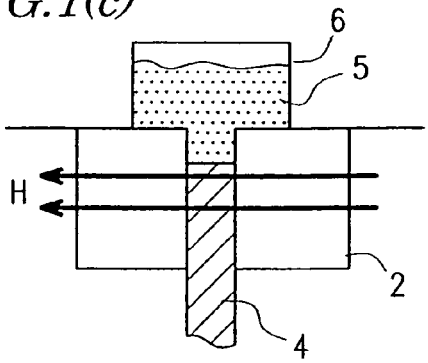
Figure 1F:
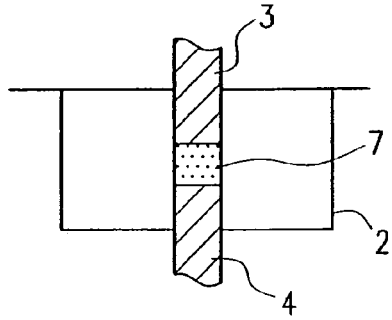

The present inventors discovered that if an oscillating magnetic field such as an alternating magnetic field is applied to a magnetic powder being fed into the cavity of a press machine, an anisotropic bonded magnet having a sufficiently high degree of alignment can be obtained even when its magnetic field strength is smaller than that of the conventional aligning static magnetic field by one or more orders of magnitude. The present inventors obtained the basic idea of the present invention in this manner.

According to the present invention, the strength of the magnetic field (i.e., peak magnetic field) to be applied for alignment purposes can be low enough to reduce the remanence of the as-pressed compact sufficiently. Thus, there is no need to perform any additional degaussing process thereon.

It should be noted that a technique of aligning a magnetic powder effectively by applying an aligning magnetic field to the magnetic powder being transported (i.e., dropped) into a cavity is already described in Japanese Laid-Open Publications Nos. 2001-93712 and 2001-226701. In the present invention, however, an anisotropic bonded magnet compaction process is carried out with a significantly smaller oscillating magnetic field than that disclosed in any of these publications, thereby reducing the surface flux density, resulting from the remanence of the compact, to 0.005 tesla or less without performing any degaussing process step. According to the present invention, no aligning magnetic field generator of a big size is needed anymore unlike the conventional process and the cycle time of the pressing process can be shortened significantly.

Hereinafter, a method for producing an anisotropic bonded magnet according to a preferred embodiment of the present invention will be described with reference to the accompanying drawings.

FIGS. 1(*a*) through 1(*f*) show main process steps (i.e., from the process step of feeding a powder under an aligning magnetic field to the process step of compacting the powder) of a magnet producing method according to the present invention. The press machine 10 shown in FIG. 1 includes a die 2 having a through hole 1, an upper punch 3 and a lower punch 4, which are able to reciprocate inside of the through hole 1 and with respect to the die 2, and a powder feeder (e.g., feeder box) 6 for feeding a magnetic powder (i.e., a compound) 5 into a cavity that is defined inside of the through hole 1 of the die 2. The press machine 10 further includes an oscillating magnetic field applying apparatus (not shown) for applying a weak oscillating magnetic field H (i.e., an alternating magnetic field of which the peak magnetic field is preferably 120 kA/m or less, more preferably 100 kA/m or less and most preferably 80 kA/m or less) to the magnetic powder 5 being transported into the cavity.

Hereinafter, a method for producing an anisotropic bonded magnet with the machine shown in FIG. 1 will be described.

First, a mixture (i.e., a compound) 5 of the HDDR powder described above and a binder (i.e., a binder resin) is prepared and then loaded into a feeder box 6 as shown in FIG. 1(*a*). Thereafter, as shown in FIG. 1(*b*), the feeder box 6 is transported to over the die 2 of the press machine 10. More specifically, the feeder box 6 is positioned just over a portion of the die 2 where a cavity will be defined. In this preferred embodiment, the upper surface of the die 2 is leveled with that of a lower punch 4 and no cavity space has been created yet at this time.

Next, as shown in FIGS. 1(*c*) and 1(*d*), the lower punch 4 is lowered with respect to the die 2 with an oscillating magnetic field H having alternating magnetic field directions (i.e., an alternating magnetic field) applied thereto. As the lower punch 4 falls, a cavity is created and grows under the feeder box 6. The compound 5 in the feeder box 6 is absorbed and loaded into the cavity that increases its size as the lower punch 4 falls.

While the cavity is being filled with the powder in this manner, the powder particles, included in the compound 5, are effectively aligned under the alternating magnetic field. This is believed to be because the respective powder particles being transported into the cavity can rotate relatively easily due to their decreased fill density.

The application of an alternating magnetic field as adopted in the present invention can contribute even more effectively to the alignment of the powder particles being loaded than the application of a static magnetic field. That is to say, if the static magnetic field is applied, the powder particles will be cross-linked together between the inner wall surfaces of the cavity to block the cavity partially. As a result, the powder cannot be loaded uniformly. On the other hand, if the alternating magnetic field is applied, then the magnetic field strength will become zero when the magnetic field direction changes. Accordingly, the magnetic cross-linking state of the powder particles collapses and the powder can be loaded uniformly and rapidly.

The alternating magnetic field for use in this preferred embodiment preferably has a frequency of at least 10 Hz, more preferably 30 Hz or more. The higher the frequency of the alternating magnetic field to be applied, the better the magnetic properties tend to be. However, if the frequency of the alternating magnetic field becomes too high, then the die of the press machine will generate some heat due to eddy current and the magnetic properties will be saturated, too. For that reason, the alternating magnetic field preferably has a frequency of 60 Hz to 120 Hz.

It should be noted that the cross-linking of the powder that blocks the cavity can also be broken off by creating a magnetic field having a certain direction and by changing the magnetic field strength in pulses instead of applying the alternating magnetic field. The key to the present invention is that the strength of the aligning magnetic field should be intermittently decreased to either zero or a sufficiently low level so as to break off the cross-linking of the powder in the cavity by applying the aligning magnetic field. Accordingly, it is not always necessary to invert the direction of the magnetic field alternately.

In applying such an aligning magnetic field that oscillates in pulses (i.e., a pulse magnetic field), the lowest level of the magnetic field applied does not have to be equal to zero but may be low enough to break off the magnetic cross-linking of the powder particles (e.g., to 8 kA/m or less).

In this manner, according to the present invention, a compound including the HDDR powder is fed into the cavity with a magnetic field, which oscillates between a magnetic field strength exceeding a predetermined level (i.e., the "ON" level of the aligning magnetic field) and a magnetic field strength that is lower than the predetermined level and is low enough to break off the magnetic cross-linking (i.e., the "OFF" level of the aligning magnetic field), applied thereto. Thus, even a cavity having such a shape as not to be feedable easily by a conventional method can also be filled with the compound smoothly and uniformly. As a result, the unit weight of the compact can be increased.

Next, after the feeder box 6 has been brought back from over the cavity to a retreated position as shown in FIG. 1(*e*), the upper punch 3 is lowered as shown in FIG. 1(*f*), thereby compressing the compound 5 in the cavity and obtaining a compact 7.

According to the present invention, a sufficiently high degree of alignment is achieved even with a weak magnetic field. Thus, the magnitude (i.e., the maximum value) of the aligning magnetic field can be reduced significantly compared with a conventional one. Accordingly, the magnetization of the compact that has just been compressed under the aligning magnetic field (i.e., the remanence) can be reduced by at least one order of magnitude as compared with the conventional one. Thus, various operations that have been required in the conventional process step of aligning the loaded powder under a strong magnetic field (e.g., once creating a very small space over the powder in the cavity to get the powder aligned more easily, aligning the powder in such a state, and immediately pressing and compressing the powder to obtain a compact) are not needed anymore. In addition, the compact 7 does not have to be subjected to any degaussing process, either. As a result, according to the present invention, the cycle time of the pressing process can be shortened to approximately equal to that of an isotropic magnet (i.e., half or less of that of the conventional anisotropic bonded magnet).

It should be noted that while the compound 5 is being compressed by the upper and lower punches 3 and 4, the aligning magnetic field may also be applied thereto. The aligning magnetic field may be applied even during the compressing process step to maintain appropriate alignment because the alignment might be disturbed in the compressing process step. The magnetic field to be applied in the compressing process step may have a strength that is equal to or lower than the magnetic field strength in the feeding process step. This is because this magnetic field is applied just to eliminate the disturbance of the alignment. For that reason, the aligning magnetic field to be applied in the compressing process step does not have to be the oscillating magnetic field, either. Thus, the oscillating magnetic field may be applied in the feeding process step and a static magnetic field may be applied in the compressing process step. However, to simplify the process, the oscillating magnetic field that has been applied for the feeding process step is preferably continuously applied in the compressing process step, too. This is because if the oscillating magnetic field is applied continuously, there is no need to finely synchronize the operation timings of respective portions of the press machine with the application timings of the magnetic fields.

Figure 2A:
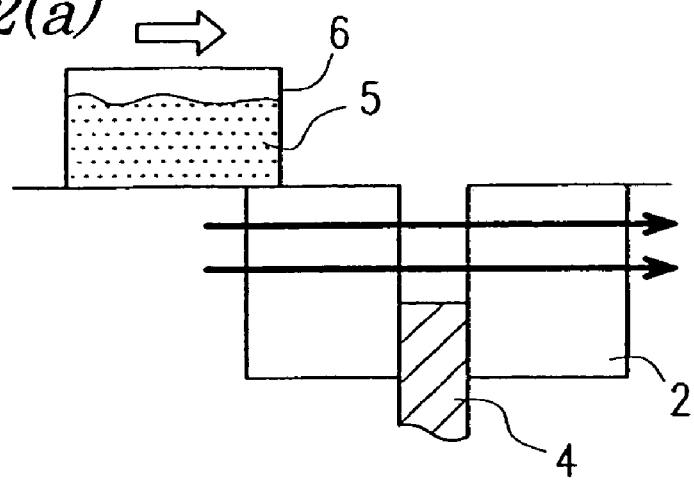
FIGS. 2(*a*) through 2(*c*) are cross-sectional views showing how the main members of a press machine according to another preferred embodiment of the present invention operate in respective manufacturing process steps.
Figure 2B:
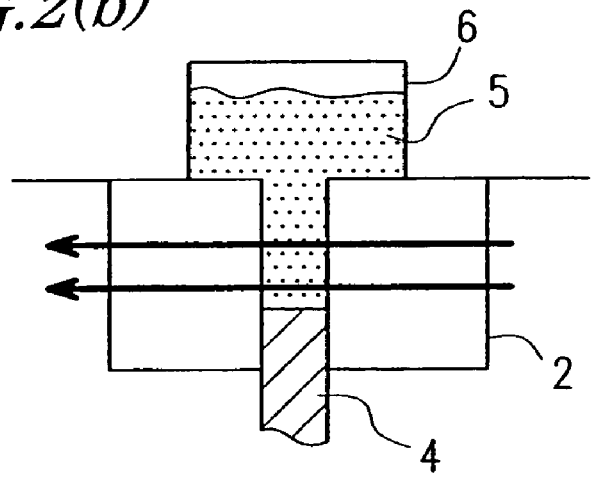
Figure 2C:
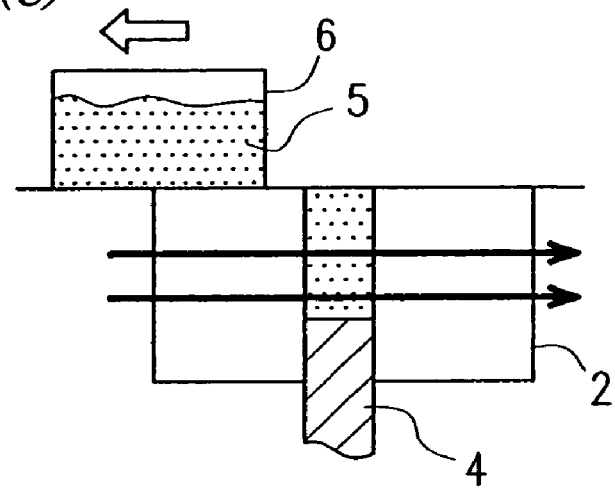

In the preferred embodiment described above, the feeder box 6 is transported to over a region where the cavity will be defined, and then the cavity space is created. However, the present invention is in no way limited to such a feeding method. Alternatively, as shown in FIGS. 2(*a*) through 2(*c*), the feeder box 6 may be transported to over the cavity that has already been created such that the compound 5 may be dropped from the feeder box 6 into the cavity. In that case, before the feeder box 6 is positioned over the cavity, the aligning magnetic field (i.e., oscillating magnetic field) starts being applied to the space including the cavity. Then, the compound 5 dropping down from the feeder box 6 into the cavity can be aligned appropriately with the small oscillating magnetic field.

In the preferred embodiments of the present invention described above, the oscillating magnetic field is applied horizontally, i.e., perpendicularly to the pressing direction (i.e., uniaxial compressing direction). Thus, the powder particles, filling the cavity, are aligned horizontally and laterally. Due to magnetic interactions, the powder particles are chained together horizontally and laterally. Powder particles, which are located on the upper surface of the loaded powder, are also chained together horizontally. As a result, the powder can be easily stored in the cavity completely without overflowing from the cavity.

It should be noted that the center axis of the cavity of the press machine may define a tilt angle with respect to the perpendicular direction. Also, the direction of the aligning magnetic field may also define some tilt angle with respect to the horizontal direction. These arrangements are appropriately determined depending on exactly in what shape the bonded magnet should be formed.

Figure 8:
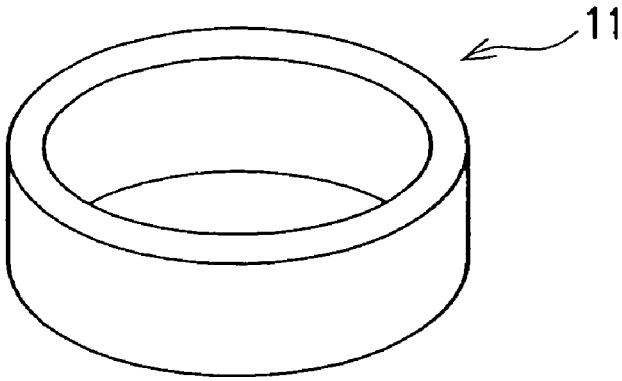
FIG. 8 is a perspective view illustrating a radially aligned ringlike anisotropic bonded magnet.

Also, according to the present invention, a radially aligned ringlike anisotropic bonded magnet 11 such as that shown in FIG. 8 can be obtained. Such a radially aligned ringlike anisotropic bonded magnet 11 may be made with a press machine having the configuration shown in FIG. 9, for example.

Figure 9:
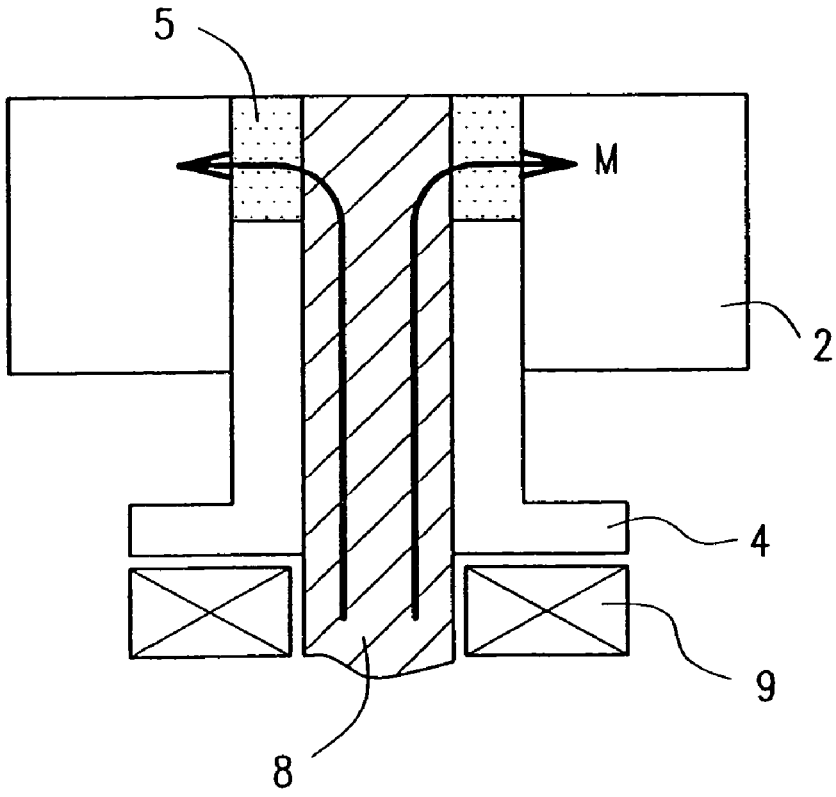
FIG. 9 illustrates an exemplary configuration for a press machine for producing the radially aligned ringlike anisotropic bonded magnet.

In the press machine shown in FIG. 9, a through hole is provided at the center of a die 2 made of a ferromagnetic material. A cylindrical core 8, which is also made of a ferromagnetic material, is inserted into the center of the through hole. The cavity is defined between the inner wall of the die through hole and the outer surface of the core 8. The bottom of the cavity is defined by the upper surface of a lower punch 4 made of a non-magnetic material.

In the press machine shown in FIG. 9, an exciting coil 9 is provided around the lower portion of the core 8 so as to apply an oscillating magnetic field. By supplying an alternating current to the exciting coil 9, for example, a radially aligning magnetic field may be generated within the cavity as an oscillating magnetic field with a predetermined strength. If the cavity is loaded with the compound in such a state, the desired alignment can be achieved.

In the example illustrated in FIG. 9, the exciting coil 9 is provided around the core 8. However, the present invention is in no way limited to this specific preferred embodiment. Alternatively, an upper core (not shown) may be provided over the core 8 and another exciting coil may be provided around the upper core.

The present inventors discovered and confirmed via experiments that the arrangement including the upper and lower cores and upper and lower exciting coils could slightly improve the magnetic properties of the compact as compared with the arrangement including just one pair of core and exciting coil. However, when such a press machine including the exciting coil around the upper core is used, the work efficiency decreases due to the attraction of the powder particles to the upper core and the construction of the press machine gets complicated, too. For that reason, the arrangement shown in FIG. 9, in which the exciting coil is provided only around the lower core, is preferred.

EXAMPLES

Hereinafter, specific examples of the present invention will be described.

First, in this specific example, an HDDR powder of an Nd—Fe—B based rare-earth alloy, including 27.5 wt % of Nd, 1.07 wt % of B, 14.7 wt % of Co, 0.2 wt % of Cu, 0.3 wt % of Ga, 0.15 wt % of Zr and Fe as the balance, was prepared. Specifically, first, a rare-earth alloy material having such a composition was thermally treated at 1,130° C. for 15 hours within an Ar atmosphere and then collapsed and sieved by a hydrogen occlusion process. Thereafter, the resultant powder was subjected to an HDDR process, thereby obtaining an HDDR powder having magnetic anisotropy. The mean particle size of the powder (as measured by laser diffraction analysis) was about 120 μm.

The HDDR powder was mixed with a binder (binder resin) of bisphenol A epoxy resin, which was heated to 60 degrees, using a biaxial kneader, thereby making an HDDR compound. The binder was about 2.5 wt % of the overall mixture.

Figure 3A:
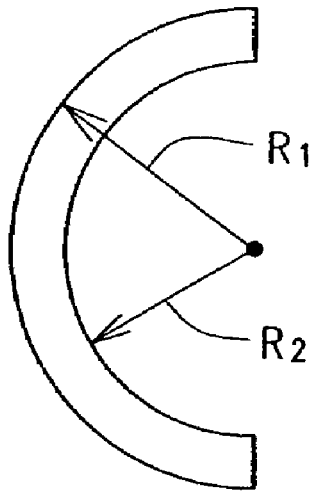
FIG. 3(*a*) illustrates the shape of a cavity opening, and FIG. 3(*b*) illustrates a thin ringlike anisotropic bonded magnet consisting of a pair of compacts.
Figure 3B:
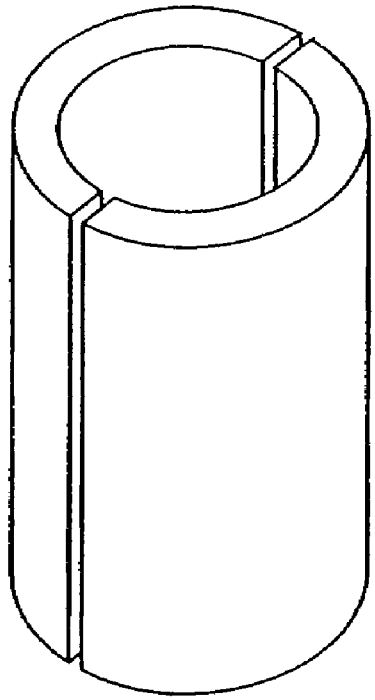

This HDDR compound was compressed and compacted by using a press machine such as that shown in FIG. 1 under an alternating magnetic field at 60 Hz. The opening of the die cavity of the press machine (i.e., on the upper surface of the die) had an arched shape (i.e., a cross-sectional shape of the cavity as taken perpendicularly to the pressing direction) as shown in FIG. 3(*a*). The dimensions of the cavity included an outside radius R1 of 19.7 mm, an inside radius R2 of 16 mm and a depth of 30.65 mm. The compound was loaded into the cavity so as to have a powder height (i.e., a fill depth) of 30.65 mm. The dimensions of a compact resulting from such a cavity included an outside radius of 19.7 mm, an inside radius of 16 mm and a height of 19 mm. By combining resultant two compacts together as shown in FIG. 3(*b*), an almost radially aligned thin ringlike anisotropic bonded magnet can be obtained.

Figure 4:
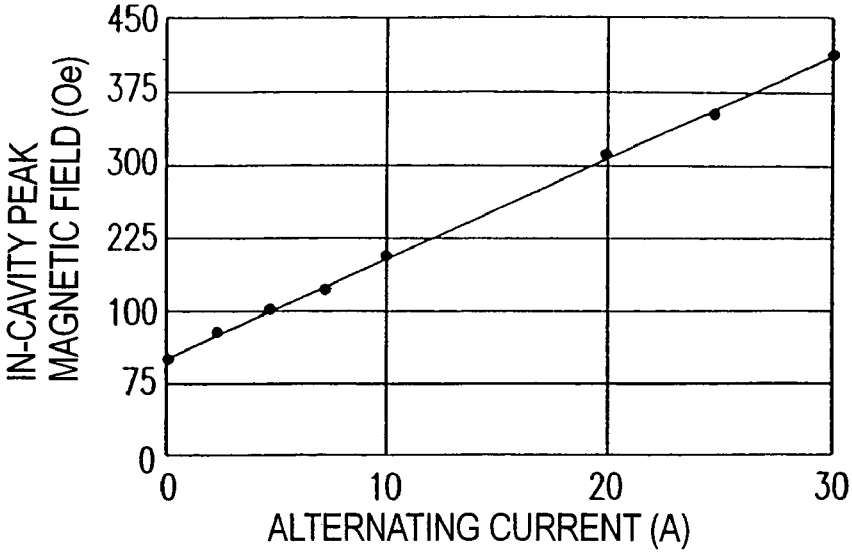
FIG. 4 is a graph showing a relationship between the current that was supplied to a magnetic field generating coil to create an alternating magnetic field (i.e., alternating current) and the peak magnetic field within the cavity.

FIG. 4 shows a relationship between the current that was supplied to the magnetic field generating coil of the press machine to create the alternating magnetic field (i.e., alternating current) and the peak magnetic field at the center of the cavity. As can be seen from FIG. 4, the peak value of the alternating magnetic field, created within the cavity, increases linearly as the amount of alternating current to be supplied to the magnetic field generating coil increases. Accordingly, by adjusting the amount of the alternating current to be supplied to the coil, the peak value of the alternating magnetic field applied to the powder can be controlled. It should be noted that the magnetic field strength as the ordinate of the graph is represented in Oe (oersted). A magnetic field strength according to the SI system of units is obtained by multiplying this value by $10^3/(4\pi)$. Since $10^3/(4\pi)$ is approximately equal to 80, 200 Oe is about 16 kA/m according to the SI system of units.

The direction of the alternating magnetic field, created within the cavity, was perpendicular to the pressing direction (i.e., the direction in which the upper and lower punches went up and down). According to the graph shown in FIG. 4, even when the alternating current supplied was 0 A (amperes), a magnetic field was still generated within the cavity. This is because the ferromagnetic members, making up the die that was used in the experiments, were weakly magnetized. If such remanence is present in the die members in this manner, then the center of the amplitude of the alternating magnetic field generated by the coil shifts from the zero level. Even so, no serious problems will arise. Rather, such remanence is preferably present because an alternating peak magnetic field required for alignment purposes can also be obtained even if a small amount of power is supplied to the magnetic field generating coil.

Figure 5:
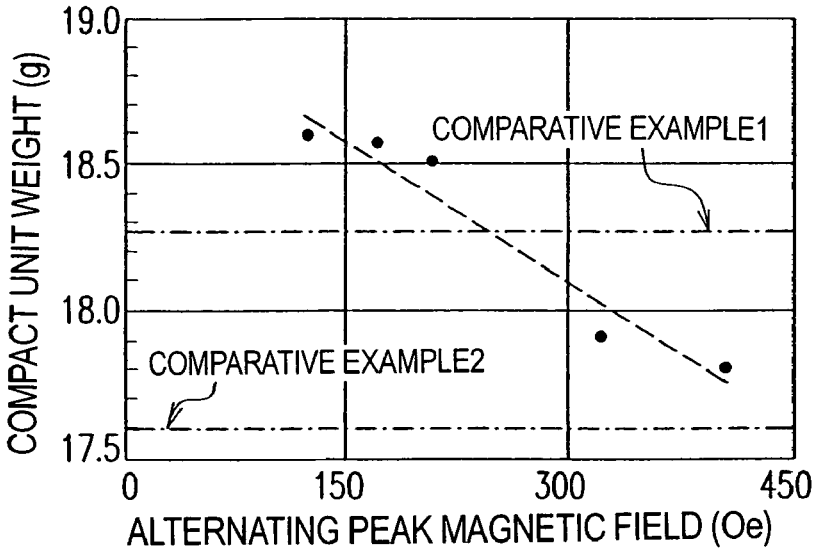
FIG. 5 is a graph showing relationships between the alternating peak magnetic field and the weight (i.e., unit weight) of the resultant compact.

FIG. 5 shows relationships between the alternating peak magnetic field and the weight (i.e., unit weight) of the resultant compact. As can be seen from FIG. 5, the higher the alternating peak magnetic field, the lower the unit weight of the compact. As the powder can be loaded more smoothly, the unit weight increases. For that reason, it is believed that if the alternating peak magnetic field is increased excessively, then it becomes difficult to load the powder as intended. Also, when the alternating magnetic field is applied, the die and other members of the press machine will generate heat. Accordingly, if the alternating peak magnetic field is intensified unnecessarily, then the die needs to be cooled in view of productivity and quality of the magnet. The magnitude of the alternating peak magnetic field is preferably determined according to the desired shape and dimensions of the compact to be obtained, the magnetic properties and alignment direction (e.g., radial alignment or perpendicular alignment) of the magnetic powder, and so on.

If the alternating peak magnetic field is intensified excessively, then the compact that has been just pressed by the press machine will also have an increased surface flux density (remanence). As a result, the original objects of the present invention cannot be achieved anymore. In addition, the powder cannot be loaded smoothly and the die will generate heat as described above. In view of these considerations, the alternating peak magnetic field preferably has a strength of at most 120 kA/m (approximately 1,500 Oe), more preferably 100 kA/m (approximately 1,260 Oe) or less, and even more preferably 80 kA/m (approximately 1,000 Oe) or less. Or the magnetic field strength may also be 50 kA/m (approximately 630 Oe) or less.

As is clear from FIG. 6 (to be described later), the bonded magnet to be obtained in this specific example can achieve desired magnetic properties in the vicinity of 300 Oe (approximately 24 kA/m). Accordingly, a magnet having a predetermined unit weight can be obtained at such a magnetic field strength as not to interfere with powder loading. More specifically, if the alternating peak magnetic field is 450 Oe (approximately 36 kA/m) or less, a sufficient compact unit weight is achievable. The alternating peak magnetic field preferably falls within the range of 24 kA/m to 36 kA/m, more preferably within the range of 24 kA/m to 32 kA/m.

For reference purposes, the graph of FIG. 5 also shows how compact unit weights changed in comparative examples Nos. 1 and 2 in which the powder was aligned with a relatively weak "static magnetic field" applied thereto. In comparative example No. 1, the static magnetic field had a strength of 60 Oe during the feeding and compacting process steps. In comparative example No. 2 on the other hand, the static magnetic field had a strength of 150 Oe. Comparing these comparative examples Nos. 1 and 2 with the specific example of the present invention, it can be seen that at the same magnetic field strength, the greater compact unit weight is achieved by applying the alternating magnetic field rather than by applying the static magnetic field. Furthermore, the specific example of the present invention resulted in a smaller unit weight variation from one pressing process to another than the comparative examples. These results show that the powder can be fed more smoothly by applying the alternating magnetic field rather than by applying the static magnetic field. Consequently, the present invention can be used particularly effectively in a situation where an anisotropic bonded magnet needs to be obtained using a cavity that is not easy to feed with the powder (e.g., a cavity having an aspect ratio (the ratio of the depth to the smallest size of the opening) of 1 or more).

Figure 6:
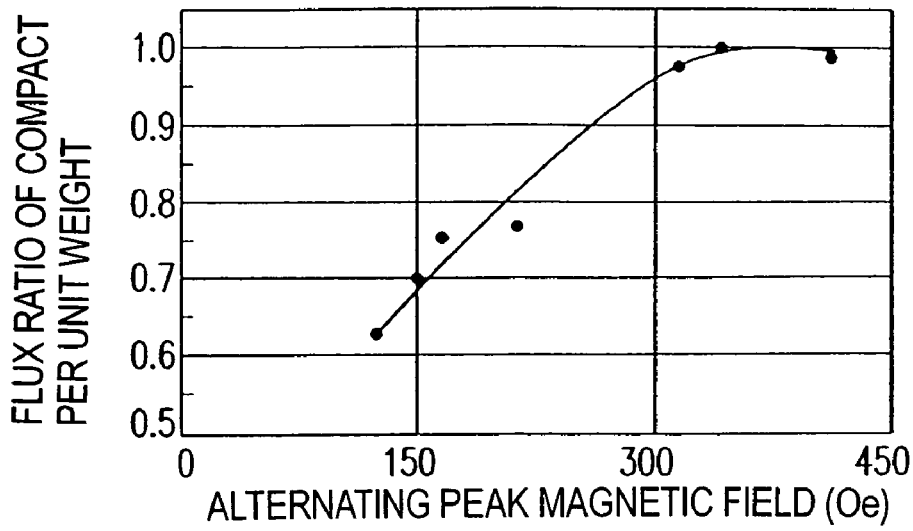
FIG. 6 is a graph showing a relationship between the magnetic property of a compact per unit weight and the alternating peak magnetic field.

FIG. 6 shows a relationship between the magnetic property of the compact per unit weight and the alternating peak magnetic field. In FIG. 6, the ordinate represents the ratio of the flux (density) of the specific example of the present invention to that of comparative example No. 3 (i.e., a compact that was aligned by applying a strong static magnetic field of 10 kOe thereto). As can be seen from FIG. 6, when the alternating peak magnetic field exceeded 300 Oe, the flux of the specific example reached a level almost equal to that of comparative example No. 3 and was substantially saturated.

Next, as for a specific example that was obtained at an alternating peak magnetic field of 420 Oe (approximately 33.6 kA/m), the surface flux density (i.e., remanence) of the as-press compact (that had not been subjected to any degaussing process yet) measured 10 gauss (=0.001 tesla) or less. To omit the degaussing process on a compact, the remanence of the as-pressed compact is preferably reduced to 50 gauss (=0.005 tesla) or less. In this specific example, the strength of the aligning magnetic field is sufficiently lower than the conventional one. Accordingly, just a magnetization of less than 50 gauss remains in the compact that has been aligned under the magnetic field and no degaussing process is needed anymore. It should be noted that the anisotropic bonded magnet obtained in this manner was magnetizable very well.

In contrast, in the prior art in which the powder that had been fed was compressed and compacted with a strong static magnetic field (of about 10 kOe, for example) applied thereto (i.e., in comparative example No. 3), the remanence of the compact reached as much as 2,000 gauss (0.2 tesla) and the degaussing process was indispensable.

Figure 7:
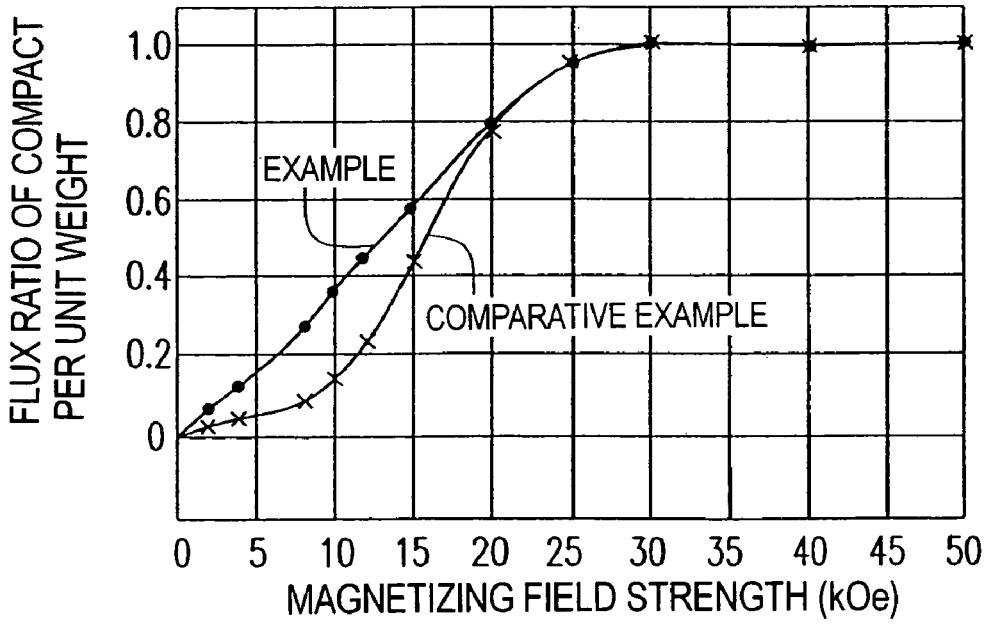
FIG. 7 is a graph showing relationships between the flux ratio of a compact per unit weight and the strength of the magnetizing field.

FIG. 7 is a graph showing relationships between the flux ratio of a compact per unit weight and the strength of the magnetizing field (i.e., magnetizing characteristic curves) for a specific example of the present invention and a comparative example. In this graph, the solid circles ● represent the data points of the specific example of the present invention while the crosses X represent the data points of the comparative example. The specific example of the present invention was a sample that was subjected to powder feeding and compacting process steps with an alternating magnetic field having a peak of 400 Oe applied thereto but that was not subjected to any degaussing process. On the other hand, the comparative example was a sample that was compacted with a static magnetic field of 12 kOe applied thereto as an aligning magnetic field and then subjected to a degaussing process with an alternating magnetic field applied thereto.

As can be seen from the magnetizing characteristic curves shown in FIG. 7, in the range where the magnetizing field strength is 0 kOe to 10 kOe, the ratio ($\Delta B/\Delta H$) of the increase in flux density ($\Delta B$) to the increase in magnetizing field strength ($\Delta H$) was greater in the specific example of the present invention than in the comparative example. More specifically, supposing the flux density at a magnetizing field strength of 40 Oe is 100%, the $\Delta B/\Delta H$ ratio of the specific example in the field strength range of 0 kOe to 10 kOe was 2%/kOe, which shows that the specific example was magnetizable much more easily than the comparative example. It should be noted that 10 kOe is equivalent to approximately 800 kA/m and 2%/kOe is equivalent to approximately 0.025%/(kA/m). Thus, according to the present invention, a $\Delta B/\Delta H$ ratio of at least 0.025%/(kA/m) is achieved with a magnetic field of 0 kA/m to 800 kA/m.

In the specific example described above, an anisotropic bonded magnet is produced with an HDDR powder. However, the present invention is in no way limited to such a specific example. Rather, any other type of powder may also be used as long as the powder exhibits magnetic anisotropy. Alternatively, a bonded magnet may also be made of a mixture of the HDDR powder and another anisotropic powder.

Furthermore, the die cavity of the press machine does not have to have the shape adopted in the specific example described above, either, but may have any other arbitrary shape. It should be noted, however, that the present invention achieves particularly significant effects on a cavity, which is normally hard to feed with the powder (e.g., a shape having an opening with the smallest horizontal size of 5 mm or less and the greatest depth of 10 mm or more).

Next, a radially aligned ringlike anisotropic magnet such as that shown in FIG. 8 was produced with a press machine having the configuration shown in FIG. 9. The resultant magnet had an outside diameter of 25 mm, an inside diameter of 23 mm, and a height of 4.8 mm. An HDDR compound that had the same composition and prepared by the same method as that described above was used as the magnetic powder.

The magnetic properties (i.e., flux densities per unit weight) of the compact and the surface flux densities (i.e., remanences) of the as-press compact (that was subjected to no degaussing process) were measured with the alternating peak magnetic fields of 80 kA/m (approximately 1,000 Oe), 40 kA/m (approximately 500 Oe) and 24 kA/m (approximately 300 Oe) applied thereto.

As a result, the difference in magnetic property according to the magnitude of the alternating peak magnetic field was as small as about 0.5%. Each compact had a remanence of 0.0007 tesla (7 gauss) or less. Particularly at an alternating peak magnetic field of 24 kA/m, the present inventors confirmed that the remanence was 0.0005 tesla (5 gauss) or less, no degaussing process was needed and the compact was magnetizable very well.

INDUSTRIAL APPLICABILITY

According to the present invention, an oscillating magnetic field is applied to the powder being fed. Thus, the magnetic powder can be aligned with the direction of the aligning magnetic field while being loaded into the cavity smoothly. For that reason, even though the magnetic field being applied has a low strength, a sufficient degree of magnetic field alignment is achieved when the powder has been loaded. As a result, according to the present invention, the magnetization, remaining in the as-pressed compact, can be reduced significantly, and therefore, no degaussing process is required anymore. Consequently, according to the present invention, while various problems resulting from the remanence are avoided, the cycle time of the pressing process can be shortened and an anisotropic bonded magnet with excellent properties can be produced at a low cost.

In addition, according to the present invention, an oscillating magnetic field is applied as an aligning magnetic field to the powder being fed. Accordingly, even a cavity having no easily feedable shape can also be filled with the magnetic powder just as intended, and the variation in the unit weight of the compact can be reduced. Consequently, even a small anisotropic bonded magnet of a complex shape can be produced with a good yield.

The invention claimed is:

1. A method for producing a permanent magnet by feeding a magnetic powder into a cavity of a press machine and compacting the magnetic powder, the method comprising the steps of:

applying an oscillating magnetic field to a space including the cavity;

moving the magnetic powder toward the inside of the cavity while aligning the magnetic powder parallel to the direction of the oscillating magnetic field; and compacting the magnetic powder inside of the cavity, thereby obtaining a compact, wherein the oscillating magnetic field within the cavity has its maximum value adjusted such that the compact, which has just been pressed by the press machine, has a surface flux density of 0.005 tesla or less, and wherein the maximum value of the oscillating magnetic field within the cavity is adjusted to 120 kA/m or less.

2. The method of claim 1, wherein the oscillating magnetic field is also applied in the step of compacting the magnetic powder inside of the cavity.

3. The method of claim 1, wherein the maximum value of the oscillating magnetic field within the cavity is adjusted to 100 kA/m or less.

4. The method of claim 1, wherein the maximum value of the oscillating magnetic field within the cavity is adjusted to 80 kA/m or less.

5. The method of claim 1, wherein after the magnetic powder has been compacted inside of the cavity, the compact is unloaded from the cavity without being subjected to any degaussing process.

6. The method of claim 1, wherein the oscillating magnetic field is an alternating magnetic field.

7. The method of claim 1, wherein the oscillating magnetic field includes a plurality of pulse magnetic fields.

8. The method of claim 1, wherein the cavity has an opening of which the smallest portion has a horizontal size of 5 mm or less, and wherein the biggest portion of the cavity has a depth of 10 mm or more.

9. The method of claims 1, wherein at least a portion of the magnetic powder is an HDDR powder.

10. The method of claim 1, wherein the press machine comprises:

a die having a through hole; and a lower punch, which reciprocates inside of the through hole and with respect to the die, and wherein the step of moving the magnetic powder toward the inside of the cavity includes the steps of:

positioning a feeder box, including the magnetic powder, over the through hole of the die after the through hole has been closed up with the lower punch; and moving the lower punch downward with respect to the die, thereby defining the cavity under the feeder box.

* * * * *